US005105992A

United States Patent [19]

Fender et al.

[11] Patent Number: 5,105,992

[45] Date of Patent: Apr. 21, 1992

[54] SOAPDISPENSER HAVING A SQUEEZE PUMP

[76] Inventors: Franklin D. Fender, Rte. 1, Box 348, Groveland, Fla. 32736; Fred Gibson, 644 Caduceus La., Hurst, Tex. 76053

[21] Appl. No.: 261,122

[22] Filed: Oct. 24, 1988

Related U.S. Application Data

[63] Continuation-in-part of Ser. No. 217,711, Jul. 5, 1988, abandoned, which is a continuation-in-part of Ser. No. 113,593, Oct. 28, 1987, abandoned.

[51] Int. Cl.[5] ..... B67D 5/06; B67D 37/00

[52] U.S. Cl. ..... 222/185; 222/52; 222/214; 222/325; 222/333; 251/7; 417/412

[58] Field of Search ..... 222/52, 181, 185, 214, 222/207, 209, 325, 333; 417/458, 465, 412, 413; 251/7, 10

[56] References Cited

U.S. PATENT DOCUMENTS

| | | | |
|---|---|---|---|
| 4,014,318 | 3/1977 | Dockum et al. | 417/412 |
| 4,135,647 | 1/1979 | Mascia et al. | 222/214 X |
| 4,256,242 | 3/1981 | Christine | 222/207 |
| 4,285,642 | 8/1981 | Komhyr | 417/465 |
| 4,621,567 | 11/1986 | Williams | 417/458 |
| 4,645,094 | 2/1987 | Acklin et al. | 222/52 |
| 4,722,372 | 2/1988 | Hoffman et al. | 222/52 X |

FOREIGN PATENT DOCUMENTS

| | | | |
|---|---|---|---|
| 1225972 | 8/1987 | Canada | 222/214 |

*Primary Examiner*—Michael S. Huppert
*Assistant Examiner*—Kenneth DeRosa
*Attorney, Agent, or Firm*—William M. Hobby, III

[57] ABSTRACT

A soap dispenser apparatus has a housing having a space formed in the housing for holding a soap container of a predetermined shape. The soap container has its own dispenser hose and nozzle formed therein and the dispenser hose fits through a squeeze pump and becomes part of the pump pumping the soap from the container. An electric motor has a gear box for gearing the motor down located in the housing and positioned to actuate a squeeze member to squeeze the dispenser hose against a pressure plate made of a self lubricating polymer. A sensor, such as an infrared sensor, senses a person's hand in line with the output of the soap container and dispenser nozzle and is coupled through a circuit to the electric motor to actuate the squeeze pump to pump the soap onto a person's hand positioned to receive the soap.

12 Claims, 2 Drawing Sheets

SOAPDISPENSER HAVING A SQUEEZE PUMP

This application is a continuation-in-part of application Ser. No. 217,711, filed on July 5, 1988, now abandoned for a Soap Dispenser which is a continuation-in-part of application Ser. No. 113,593, filed Oct. 28, 1987 for a Soap Dispenser, now abandoned.

BACKGROUND OF THE INVENTION

The present invention relates to automatic soap dispensers and especially to an automatic soap dispenser for dispensing soap from a soap container having a dispenser hose for fitting into a squeeze pump in the soap dispenser to form part of the pump.

BACKGROUND OF THE INVENTION

Soap dispensers are commonly used in public restroom facilities and are typically mounted above each sink. The dispenser may be of several different types including those that dispense powdered soap for actuation by a handle to open and close the valve. Granular solid soap can be dispensed by rotating a handle and, in some cases, the handle can be rotated to break up blocks of soap. A more common type of soap dispenser today, however, is one which dispenses a liquid soap and these typically are mounted over the sinks and have a push handle which activates a pump which pushes a squirt of soap into a person's hand. Several pushes will in turn deliver more soap. Since the soap dispenser is mounted directly above the sink, the user can then lower his hands to the sink for washing his hands with soap and water. These prior art soap dispensers require grabbing or pushing on a handle and this in turn assists in the spreading of microorganisms from one person to the next. In a typical soap container, janitorial personnel refill the containers on a regular basis by carrying larger bulk containers of the liquid soap or powdered soap, and opening the dispenser and pouring in additional soap. This continuous reuse of a fixed container for liquid soap also provides an ideal breeding ground for microorganisms. In contrast, a number of prior lavatories have been provided in which the water is turned on and off automatically without a person having to grasp a handle in a public facility. Typically, these systems have a proximity sensor or an infrared sensor or the like for sensing the individual hands reaching into the sink to automatically turn the water on and then to turn the water off when the individual removes his hands. Automatic flush toilets are also in use today, which in combination with the automatically actuated lavatories, do not require a user to continuously touch or grab the same handles. One prior art patent to Griffin, U.S. Pat. No. 3,639,920, illustrates a soap dispenser which does not require the hands touching the soap container to dispense the soap. This patent has a proximity sensor for a lavatory which responds to the approach of the user to turn on the water in a timed sequence to dispense the water and then the soap in accordance with a predetermined pattern. Thus, the proximity of an individual actuates the water and then turns on the soap after a predetermined pause and then turns the water back on in cycles until the user has departed from the proximity of the fixtures.

It has become common today to sell both in the retail and commercial markets, throwaway soap dispensers which are prefilled with liquid soap and which have pumps therein and a dispenser nozzle. These soap dispensers can be opened from a package and placed adjacent to a sink and merely requires an individual to push on the handle or top of a dispenser to pump a squirt of soap out of the nozzle onto his hand. This type of inexpensive liquid soap dispenser has the advantage of being a throw away container which is both inexpensive and sanitary in that it does not normally provide for continuous refilling. These types of soap dispensers are typically utilized in homes where the containers may have surface decoration to improve the aesthetics of the dispenser and where the soaps may be perfumed and have various types of hand lotions mixed therewith.

The present invention envisions the use of a custom made liquid soap container which may be rapidly changed in an automatic soap dispenser and the containers thrown away after each use.

The present invention is aimed at an automatic soap dispenser which senses an individual's hand placed in exact proper position to catch soap and then actuates an electric motor or solenoid by virtue of an electrical circuit which squeeze pumps soap from the soap container in the housing to dispense the soap into the individual's hand and thus avoids all contact with the soap dispenser or with any handle.

SUMMARY OF THE INVENTION

The present invention relates to a soap dispenser having a soap container having a flexible dispenser hose with dispenser nozzle coupled thereto. A housing has a space formed therein for holding said soap container therein with said dispenser hose and nozzle positioned to direct soap from said container through said housing. A gear box is located in the housing and has an output shaft therefrom. An electric motor is located in the housing and is coupled to the gear box for driving the output dispenser hose therethrough for dispensing soap from the container responsive to being driven by the electric motor when the electric motor is actuated. The squeeze pump includes a pressure plate located on one side of the dispenser hose and a rotating squeezing member coupled to the gear box output shaft and located on the other side of the dispenser hose for squeezing the hose against the pressure plate when the squeezing member is driven by the electric motor driving the gear box output shaft so that soap is directed through the dispenser hose from the container through the dispenser nozzle. A sensing means, such as an infrared sensor, senses a person's hand in line with the output of the soap container dispenser nozzle and a circuit couples the sensors to the electric motor for actuating the motor and pump when a person's hands are sensed in a position to receive soap from the soap dispenser. The squeeze pump pressure plate has a surface made of a self lubricating solid polymer, such as TEFLON, whereby friction is reduced on the soap container hose. The squeeze pump squeeze member may also be a self lubricating polymer material to reduce friction on the soap container hose. The squeeze pump squeeze member may have a plurality of roller bearing, each placed on a rotating arm portion of the squeeze member to thereby reduce friction on the soap container hose.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
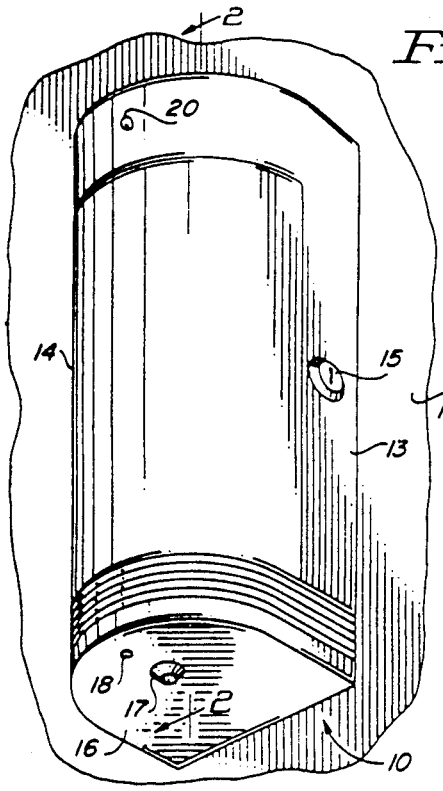
FIG. 1 is a perspective view of a soap container for use in accordance with the present invention.
Figure 2:
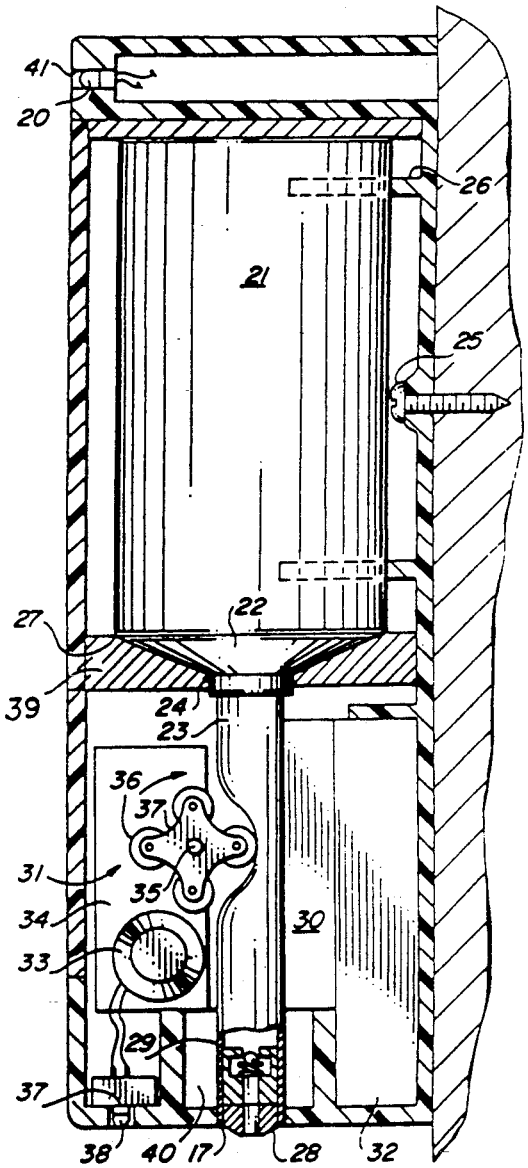
FIG. 2 is a sectional view of a soap dispenser taken on the line 2—2 of FIG. 1.

Referring to the drawings and especially to FIGS. 1 and 2, a soap dispenser 10 is shown attached to the wall 12 and having a housing 13 along with an arcuate opening door 14 which is hinged on one side and has a lock 15 on the other side thereof. The soap dispenser 10 has a bottom side 16 having a dispensing opening 17 and an infrared sensing opening 18. The soap dispenser also has a ready light 20 in front thereof. A soap container 10 is mounted inside the housing 13 as shown in FIG. 2 and includes a generally cylindrical casing 21 having an angled or truncated cone shaped end 22 having a flexible hose 23 attached to the end 24. The housing 21 can of course be square or any shape desired without departing from the spirit and scope of the invention. The soap dispenser housing 13 is mounted to the wall 12 with threaded screws 25 while bracing members 26 are inside the housing for holding the soap dispenser container 11 in proper position when the door 14 is closed. The container 11 funnel shaped end 22 fits in a base 39 having a matching funnel shaped surface 27. The hose 23 has a nozzle 28 mounted on the end thereof and protruding through the opening 17.

The hose 23 is formed as part of the container 21, so that when the container 21 is loaded, the hose is positioned between a pressure plate 30 and a rotating squeeze member 31 and becomes part of a squeeze pump in which the hose 23 is squeezed by the squeeze member 31 as it rotates to drive the flexible resilient hose 23 against the pressure plate 30 and to direct soap from the container 11 through the hose 23 and out the nozzle 28. A battery may be located in the container portion 32 to power the operation of the squeeze pump. A one way check valve 29 is mounted in the hose 23 at the bottom thereof adjacent to the nozzle 28. The check valve has a pair of walls with openings therein along with a spring loaded steel ball. The steel ball is pushed open against the spring only upon operation of the squeeze pump and closes as soon as the pressure releases. This check valve prevents the soap from dripping out and keeps the soap containers sealed. A second float valve may also be utilized in the upper portion of the tube 23 if desired.

The squeeze pump also includes an electric motor 33 which can be a DC motor driven by the battery 32 or alternatively, may be connected directly to an AC or remote power source. The motor 33 is connected to a gear box 34 which gears down the speed of the motor and increases the output torque. An output shaft 35 from the gear box 34 has the squeeze member 31 attached thereto. Squeeze member 31 in this instance has four roller bearings 36 which may be steel roller bearings, or alternatively, can be a fixed squeezed portion also made of a self lubricating polymer such as TEFLON or the like. The bearings 36 are supported on arms 37 and are spaced to continuously pump soap through the hose 23 as the squeeze member 31 rotates in a clockwise direction. The pressure plate 30 may also be a self lubricating polymer, such as TEFLON, to prevent undue friction and abrasion to the flexible hose 23.

An infrared sensor 37 has a sensing eye 38 for actuating the electric motor 34. The sensor 37 may have an SCR therein to lock the motor for a predetermined number of rotations which can be an electronic delay or alternatively a cycling cam actuated switch attached to the rotating shaft 35. The tube 23 has a holding clamp 40 to hold a nozzle 28 in place in the opening 17. The holding clamp can be a magnet holding a metal tip on the flexible pipe 23 or can be an adhesive or can simply mechanically clamp the tube 23. An LED or other light 41 is placed in the opening 20 to indicate when the dispenser is ready for dispensing additional soap.

Figure 3:
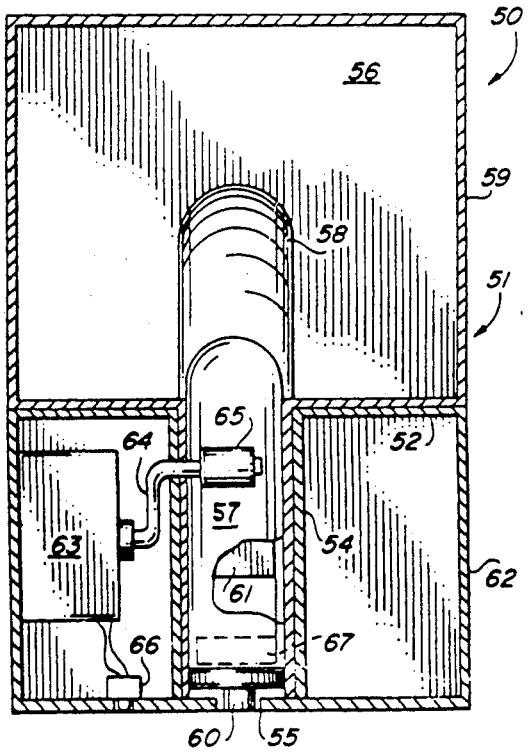
FIG. 3 is a front sectional view of an alternate embodiment of a soap dispenser in accordance with the present invention.

In operation the container 11 has the main supply housing 21 and a hose 23 along with a nozzle 28 on the end thereof which are manufactured as throw away containers. The soap dispenser housing can be opened and the container 21 slid into place and the hose 23 positioned in the squeeze pump to form a portion of the squeeze pump between the squeeze member 36 and the pressure plate 30. The hose is extended through the hose end clamping portion 40 so that the nozzle 28 protrudes through the opening 17. The door is then closed. The squeeze pump advantageously operates using only a small amount of power for dispensing soap and can dispense precise doses by the rotation of the squeeze member 35 and individual rollers 36 against the resilient flexible hose 23 forming part of the container 11. The container 11 is thrown away when it is empty and replaced with a new one so that bacteria and other microorganisms cannot accumulate in the container such as happens in those containers which are continuously refilled. Turning to FIG. 3, an alternate embodiment of a soap dispenser 50 has an outer housing 51 having dividing walls 52 therein with an opening in the middle thereof having a pair of side guides 54 extending down to a narrowed opening 55. A flexible soap bag 56 can be filled with liquid soap and placed in the upper chamber 59 which is shaped to exactly fit the flexible soap bag 56. Soap bags 56 are made with a tube 57 attached thereto and are delivered attached to the container 56 and sealed for shipment. The tube 57 can be pulled off the side portion 58 of the soap container 56 and inserted in the guide walls 54 until an end nozzle member 60, which may be made of a hard plastic, is inserted in the opening 55. A cut-away in the tube, as shown in FIG. 3, shows the pressure plate 61 mounted back of and to the side guide members 54. The lower part of the housing 62 has an electric motor and gear box 63 mounted therein with a protruding bell crank arm 64 extending therefrom and having an extended roller 65 mounted on the end thereof and spaced to just above the tube 57 in the guide walls 54 directly on the opposite side of the pressure plate 61. The motor is actuated by a sensor 66 which drives the gear box and bell crank 64 to drive the rollers 65 against the tube 57 as it pushes the tube down against the pressure plate 61. The roller 65 will roll as the bell crank 64 rotates around its cycle squeezing the soap in the tube 57 out the nozzle 60 whenever the sensor 66 senses a hand. An infrared sensor can sense the heat of a person's hand being placed under the soap dispenser. This embodiment shows a single squeeze arm 64 and roller 65 even though more than one can be attached to the motor and gear housing 63. This embodiment is similar to the one shown in FIGS. 1 and 2 except that the housing 51 is shaped for a specific flexible soap container 56 commercially available on the market which also has a soap tube extending therefrom. This system also has a spring loaded check valve 67 located in the tube 57 similar to the valve shown in FIG. 2 and may have a second check valve located in the upper part of the tube 57. The nozzle 60 comes with the soap container 56 as delivered. The soap container 56 is inserted in the upper housing 51, container portion 59 above the dividing walls 52 and the tube 57 is pulled loose and is inserted down the guide path along the walls 54 and over the pressure plate 61 but behind the roller 65 and the nozzle 60 is pushed into the opening 55. When the bell crank 64 rotates to rotate the roller 65 against the tube 57, soap is squeezed from the container 56 in the tube 57 out the nozzle 60.

Figure 4:
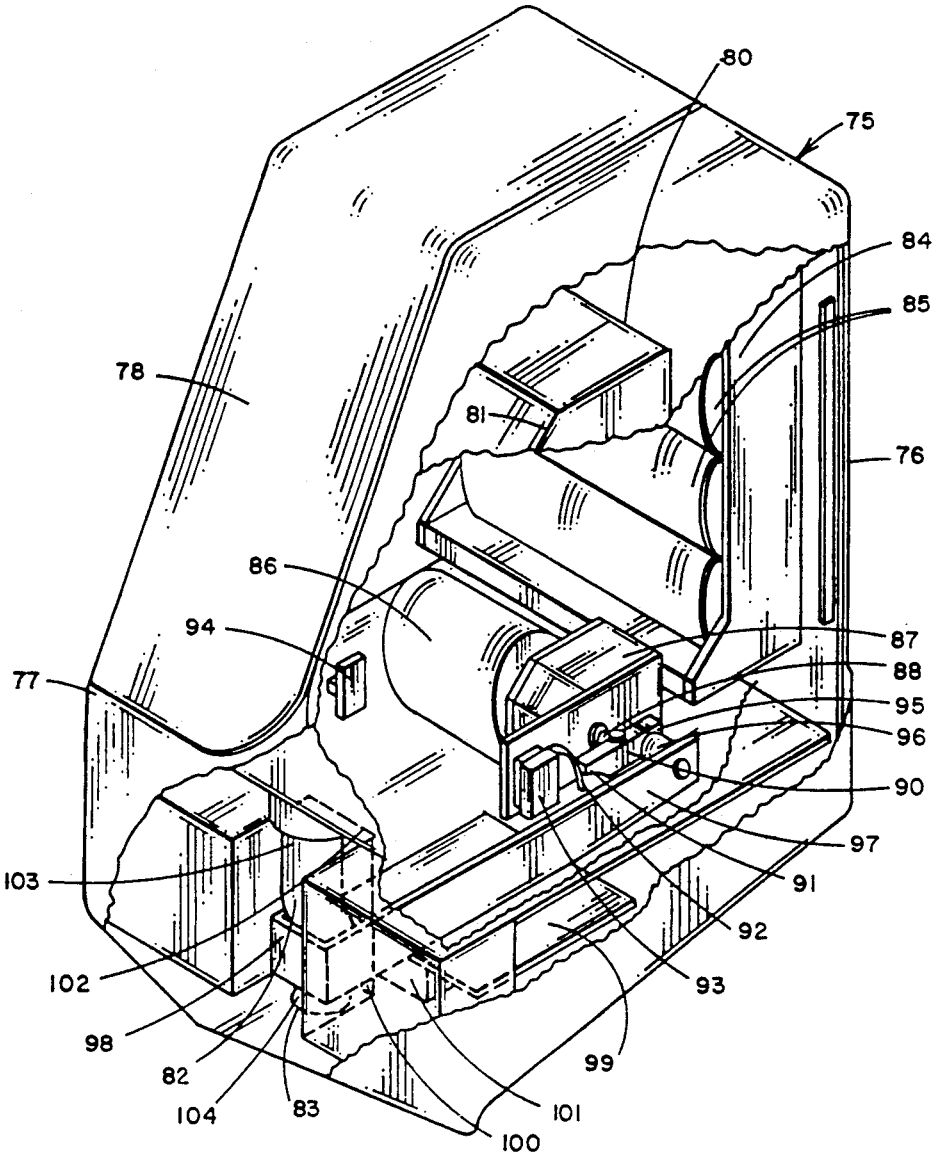
FIG. 4 is a cut-away perspective view of another embodiment of a soap dispenser in accordance with this invention.
Figure 5:
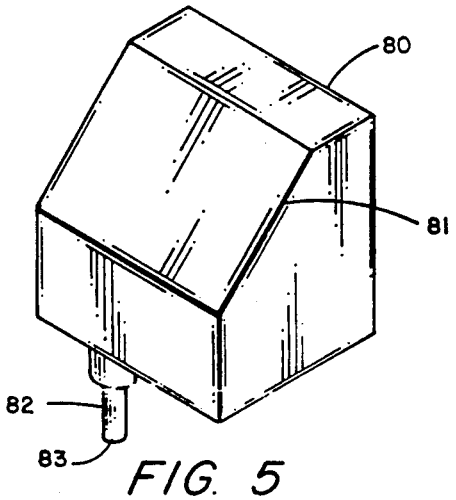
FIG. 5 is a perspective view of a soap container for use with FIG. 4 in accordance with this invention.

Turning now to FIGS. 4 and 5, a soap dispenser 75 in accordance with the present invention is illustrated having a back plate 76 and a housing 77. The top portion 78 of the housing 77 comes off for inserting a soap container 80 therein. The soap container is specially shaped in a generally square-shape except for an angled front portion 81 and has a dispensing flexible tube 82 extending therefrom to an opening 83 in the housing 77. A battery housing portion 84 can have a plurality of batteries 85 mounted therein. This embodiment has an electrical motor 86 mounted therein and driving the gear box 87 which drives an output shaft 88. The output shaft is connected to a crank arm 90. Crank arm 90 has a cam end 91 which allows it to make one rotation before the cam arm hits the arm 92 of the microswitch 93 which turns off the motor after each revolution. The motor is actuated by an infrared sensor 94. The crank end 95 of the crank arm 90 has a shaft 96 connected thereto for driving an actuating arm 97. The actuating arm has a U-shaped end 98 which slides on plate 99 and through a slotted guide 100 in a guide plate 101. Tube 82 is slid into the U-shaped portion 98 of the arm 97 when the soap container 80 is put in place.

Each rotation of the shaft 88 and crank arm 90 slides the squeeze arm 97 against the pipe 82 to squeeze the pipe 82 against the plate 102. Flexible tube 82 has a check valve 103 therein to prevent the liquid soap from being pushed back into the container 80. It also has a spring loaded valve at the end 104 similar to the valve shown in FIG. 2 thus, compressing tube 82 with the actuating arm portion 98 decreases the internal volume of the tube 82 between the check valve 103 and the valve 104 forcing the soap against the spring valve and out the opening 105 from the tube 82 and from the housing 77. This type of soap dispenser has the advantage of taking a very small amount of power to drive the arm each rotation and can be re-actuated by moving the hand under the dispenser nozzle to dispense any number of squeezes of soap.

Each time the soap container 80 of FIG. 5 is replaced, the old soap container can be disposed of along with the tube 82, thus maintaining the soap containers sanitized with a pump system which never touches the soap and utilizes the tube 82 as part of the dispenser pump. The angled surface 81 of the container 80 is made to conform to the casing 77 portion 78 but other smaller containers of different shapes will fit into the housing 77.

The gear motor pulling the crank arm one stroke at a time has been found to use considerably less power than other pumping systems and thus can be run for long periods of time on batteries, even though it should be clear that this invention can also be connected to an AC power source or through a transformer to an AC power source so as to operate with a low voltage.

The units of the present invention do not have to be sterilized and human hands never touch the soap dispenser. The containers are shipped sterilized and filled with liquid soap and allow for the rapid exchange of containers. The present invention however is not to be construed as limited to the forms shown which is to be considered illustrative rather than restrictive.

We claim:

1. A soap dispenser comprising:

a soap container having a flexible dispenser hose with dispenser nozzle coupled thereto;

a housing having a space formed therein for holding said soap container therein with said dispenser hose and nozzle positioned to direct soap from said container through said housing;

a gear box located in said housing and having an outlet shaft therefrom, said output shaft having a crank member attached thereto;

an electric motor located in said housing and coupled to said gear box for driving said output shaft;

pumping means located in said housing for receiving said dispenser hose therethrough for dispensing soap from said container responsive to the comprising of said flexible hose when actuated by said electric motor when said electric motor is actuated, said pump means including a pressure plate located on one side of said dispenser hose and a squeeze member coupled to said gear box output shaft crank arm and riding in a guide plate and located to extend part way around the other side of said dispenser hose for compressing said hose against said pressure plate when said squeezing member is pulled by said electric motor driving said gear box output shaft whereby soap is directed through said dispenser hose from said container through said dispenser nozzle; and said pump means pressure plate having a surface of a self-lubricating solid polymer material whereby friction is reduced on said soap container hose.

2. A soap dispenser in accordance with claim 1 in which the squeeze end portion is a U-shaped member.

3. A soap dispenser in accordance with claim w in which said guide plate has a guide slot therein.

4. A soap dispenser in accordance with claim 3 in which said squeeze member crank has a cam on one end thereof for camming a microswitch to switch off said electric motor.

5. A soap dispenser in accordance with claim 1 including sensing means for sensing a person's hand in line with the output of said soap container dispenser nozzle, said sensing means includes an infrared detector; and circuit means coupling said sensing means to said electric motor for actuating said motor and pump means upon said sensing means sensing a person's hand, whereby a soap dispenser operates upon a person positioning his hand to receive the soap.

6. A soap dispenser in accordance with claim 5 in which said housing has a hinged door covering said space therein.

7. A soap dispenser in accordance with claim 6 in which a pair of braces are shaped to support said soap container in said housing when said door is closed.

8. A soap dispenser in accordance with claim 7 in which said electric motor and gear box are mounted in said housing below said soap container and said soap dispenser dispenser hose extends from the bottom of a mounted soap container through said pump means.

9. A soap dispenser in accordance with claim 1 in which said pump means squeeze member is a self lubricating polymer material whereby friction is reduced on said soap container hose.

10. A soap dispenser in accordance with claim 1 in which said soap container dispenser hose is formed on said soap container and is placed in said pump means to become a portion of said pump means once mounted in said housing.

11. A soap dispenser in accordance with claim 10 in which said soap container dispenser flexible hose nozzle attached to a nozzle is outlet in said housing whereby soap is dispensed through said housing.

12. A soap dispenser in accordance with claim 1 in which said housing has an angled side for accepting a soap container having a matching angled side.

* * * * *